US009777417B2

(12) United States Patent
Beyer

(10) Patent No.: US 9,777,417 B2
(45) Date of Patent: Oct. 3, 2017

(54) FLUID REGULATING APPARATUS

(71) Applicant: Bekir Beyer, San Pedro, CA (US)

(72) Inventor: Bekir Beyer, San Pedro, CA (US)

( * ) Notice: Subject to any disclaimer, the term of this patent is extended or adjusted under 35 U.S.C. 154(b) by 226 days.

(21) Appl. No.: 14/600,875

(22) Filed: Jan. 20, 2015

(65) Prior Publication Data

US 2016/0208425 A1 Jul. 21, 2016

(51) Int. Cl.

| | |
|---|---|
| ***D06B 23/10*** | (2006.01) |
| ***D06B 1/08*** | (2006.01) |
| ***D06B 1/10*** | (2006.01) |
| ***D06B 19/00*** | (2006.01) |
| ***F26B 13/00*** | (2006.01) |
| ***F26B 13/10*** | (2006.01) |
| ***F26B 21/00*** | (2006.01) |

(52) U.S. Cl.

CPC ..... *D06B 23/10* (2013.01); *D06B 1/08* (2013.01); *D06B 1/10* (2013.01); *D06B 19/007* (2013.01); *D06B 19/0017* (2013.01); *F26B 13/00* (2013.01); *F26B 13/108* (2013.01); *F26B 21/004* (2013.01)

(58) Field of Classification Search

CPC ... B05C 5/0233; B05C 5/0225; B05C 5/0229; B05C 5/0241; B05C 5/0245; B05C 5/0254; B05C 5/0258; D06B 23/10; D06B 1/08; D06B 1/10; D06B 19/007; D06B 19/0017

See application file for complete search history.

(56) References Cited

U.S. PATENT DOCUMENTS

| | | | | |
|---|---|---|---|---|
| 1,824,885 A * | 9/1931 | Hammond | D21H 5/0052 427/209 |
| 3,467,135 A * | 9/1969 | Muskalla | F16K 31/08 137/410 |
| 3,967,581 A * | 7/1976 | Zirbel | B27N 7/00 118/410 |
| 4,860,688 A * | 8/1989 | Nazzarro | A45D 26/0014 118/410 |
| 5,156,026 A | 10/1992 | Karetnikov | |

FOREIGN PATENT DOCUMENTS

| | | |
|---|---|---|
| CN | 100427864 C | 10/2008 |
| WO | WO8705343 C | 9/1987 |
| WO | WO9849383 A1 | 11/1998 |

OTHER PUBLICATIONS

Authorized officer Shane Thomas, International Search Report/ Written Opinion in PCT/US16/13887 dated Jul. 21, 2016, 24 pages.

* cited by examiner

*Primary Examiner* — David Cormier
(74) *Attorney, Agent, or Firm* — Fish & Richardson P.C.

(57) ABSTRACT

An apparatus for dye application to textile manufactures, exhaustion of the applied dye, and drying of the textile manufacture. The apparatus, in some implementations, includes a dye applicator that applies dye evenly to a textile manufacture of varying length, one or more microwave elements for heating the textile manufacture with applied dye to exhaust the dye, and a blower system to dry the textile manufacture after application of the applied dye.

4 Claims, 9 Drawing Sheets

FLUID REGULATING APPARATUS

BACKGROUND

This specification relates dye application to textile manufactures, exhaustion of the applied dye, and drying of the textile manufacture.

During the manufacturing of textile products, such as carpet products, samples of the products are dyed to ensure that the textile product being produced is free of material, chemical or process related problems. Typically, a piece of sampled textile manufacture is dyed and examined before committing to a large amount of production to detect any possible unforeseen problems and ensure the product quality and consistency with the standards. If the dyed sample indicates the textile manufacture being produced is within acceptable specifications, then full production may commence. However, if the dyed sample indicates the textile manufacture being produced is not within acceptable specification, then remedial actions are taken, e.g., yarn problems or colorant deviation are resolved, before going into full production.

Checking a textile manufacture sample for these problems requires dyeing of a full width sample so that the defective, e.g., altered molecular structure or orientation, or contaminated, e.g., chemically different fiber mix, yarn can be traced and replaced from its relative location in the loom. With manufacturers producing textiles on looms 90 inches wide and larger, e.g., looms for upholstery, curtain or carpeting, finding a sample dyeing machine large enough to be able to dye full width sample presents challenges. The process of applying dye to textile manufacture samples, exhaustion of the applied dye, and drying of the textile manufacture is expensive and prone to error.

For example, dyeing and drying may take from 8 to 48 hours depending on the dye house work load and the communication between the departments. Such a process entails weaving a full width of a 15-20 linear feet long sample and sending it to the dye house to be dyed. The sample piece cannot be inspected until it finishes going through the entire dyeing and drying cycle with the batch it is dyed together. This results in production machinery sitting idle during the entire time the sample piece is being handled.

Another check process involves the immersion of a full width piece of the textile manufacture in a large container filled with hot water and colorant. This process is less effective than the prior process, as it typically only reveals problems for a chemically different fiber or yarn mixed in another type of fabric either during spinning or weaving processes. This process may not reveal the defective or contaminated yarn because it only "ring" dyes the fiber surface, i.e., the dye only cosmetically stains the outside of the fiber without fully penetrating the fabric, thus appearing to be consistent with the rest of the batch when, in fact, it is not. The fibers needs to be either boiled in a dye bath or steamed after the dye solution is applied on it for a considerable amount of time for any difference in its dye absorbency to be detected. Subsequently, hidden defects appear when fabric goes through proper production procedure resulting considerable amount of "factory seconds" that cannot be sold at full market value.

SUMMARY

In general, one innovative aspect of the subject matter described in this specification can be embodied in an apparatus, comprising: a platform defining a substantially flat top surface upon which a textile manufacture may be received; a first housing in movable disposition relative to the platform such that the first housing, in a first position, defines a substantially enclosed cavity in which the flat top surface of the platform defines a bottom surface of the substantially enclosed cavity, the first housing, in a second position, allows access to the top surface of the platform for placement and removal of the textile manufacture; a microwave device including a magnetron and a waveguide operatively positioned relative to the first housing when the first housing is in the first position such that magnetron guides microwaves into the substantially enclosed cavity when the magnetron is energized; a blower device that, when the first housing is in the first position, is fluidly coupled to the substantially enclosed cavity and blows air into the substantially enclosed cavity when energized; and a control subsystem electrically coupled to the microwave device and the blower device and that, during a first time period, causes the microwave device to be energized and the blower device to be de-energized and that, during a second time period after the first time period, causes the microwave device to be de-energized and the blower device to be energized.

Another innovative aspect of the subject matter described in this specification can be embodied in an apparatus comprising a first fluid reservoir defining a first volume for holding a first volume of fluid and defining a first port through which fluid may escape the first fluid reservoir; an applicator valve defining a longitudinal axis and connected to the first fluid reservoir, comprising: a casing having an inner cavity defined by a casing wall and having a first end and a second end, and further defining a first longitudinal slot through the casing wall and a second longitudinal slot through the casing wall, wherein the first and second longitudinal slots are substantially parallel to the longitudinal axis, and the first longitudinal slot is fluidly connected to the first port of the reservoir; and a rotor within the inner cavity of the casing and having a first end and a second end, and defining an outer surface and a third longitudinal slot cut through the rotor, the third longitudinal slot substantially parallel to the longitudinal axis, and wherein the rotor is operable to rotate about a rotational axis that is substantially parallel to the longitudinal axis such that the outer surface of the rotor seals the first longitudinal slot from the second longitudinal slot, and the third longitudinal slot forms a fluid path from the first longitudinal slot to the second longitudinal slot when third longitudinal slot is at least partially aligned with first and second longitudinal slots.

Particular embodiments of the subject matter described in this specification can be implemented so as to realize one or more of the following advantages. The dye exhaustion and dryer apparatus results in the uniform application of dye across an entire production sample of textile manufacture, thus reducing or eliminating inconsistent application of dye due to human error. The controlled application of microwave energy followed by a drying cycle greatly reduces sample processing time over the manual application of dye and dye exhaustion and drying. This, in turn, increases precision and application uniformity, and reduces overall dyed sample deliver time.

Furthermore, by processing text strips up to the production width of the textile mill, wasteful, costly and time-consuming check rolls that hold up the fabric forming process are eliminated.

Other advantageous uses of the apparatus include continuous range initial color checking, custom color matching, and new color line development. Furthermore, the apparatus facilitates testing such as qualitative colorant, auxiliary chemicals and topical treatment testing, low-melt fiber performance testing, multi-fiber-tone creel proofing, and latex and tile polymer curing testing.

The details of one or more embodiments of the subject matter described in this specification are set forth in the accompanying drawings and the description below. Other features, aspects, and advantages of the subject matter will become apparent from the description, the drawings, and the claims.

Figure 1A:
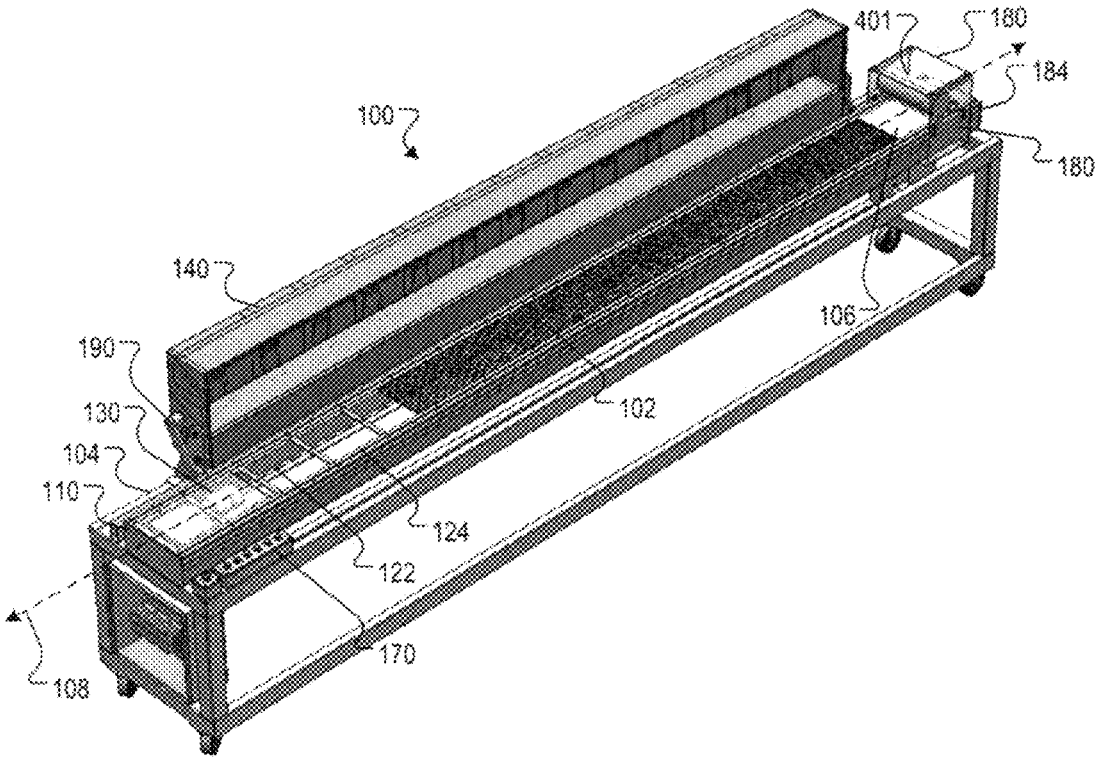
FIGS. 1A and 1B are perspective views of the dyeing and drying apparatus.

Like reference numbers and designations in the various drawings indicate like elements. To avoid congestion in the drawings and for brevity of description, reference numbers may not be repeated in subsequent drawings and descriptions of elements previously described may be omitted in subsequent drawings.

DETAILED DESCRIPTION

Figure 1B:
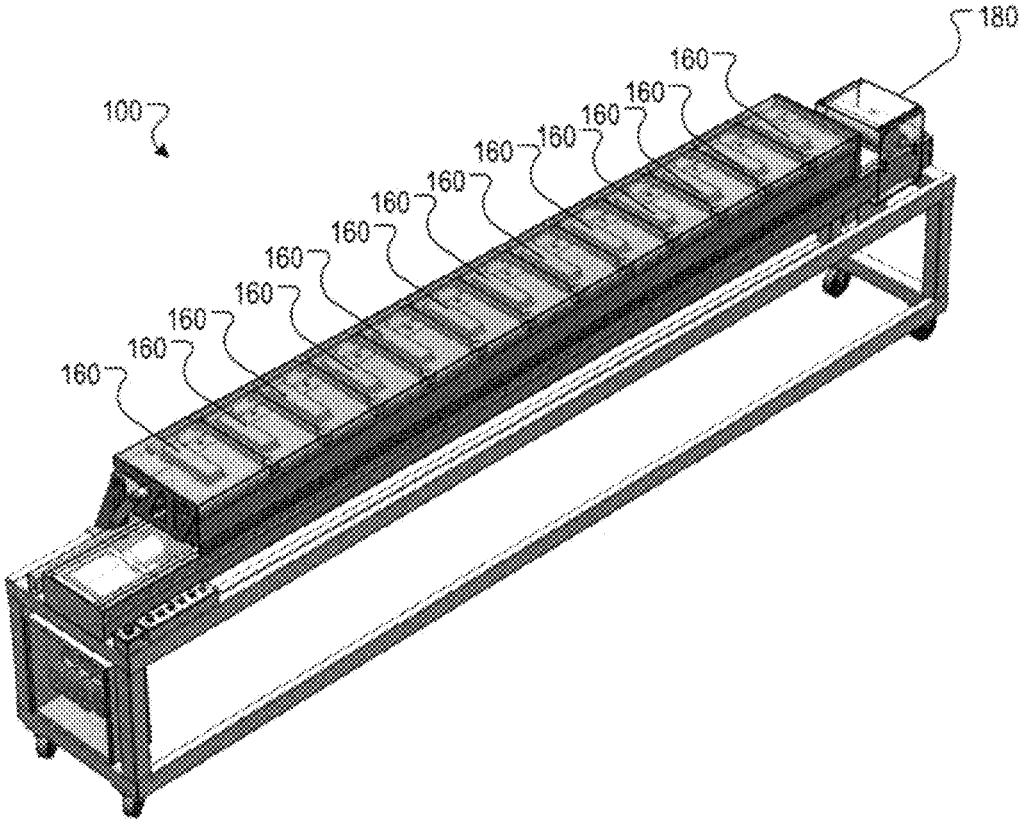

FIGS. 1A and 1B are perspective views of the dyeing and drying apparatus 100. In FIG. 1A the apparatus 100 is in an open position in which a textile manufacture 102, which for brevity shall simply be referred to as a sample 102, may be processed for dying and drying. The sample may be a carpet sample, a fabric sample, an upholstery sample, or any other textile manufacture for which a dye sampling may be required.

The apparatus 100 includes a platform 110 defining a substantially flat top surface 106 upon which the sample may be received. A portion of the surface 106 has been removed to show a supply plenum 122 and a return plenum 124, which will be described in more detail below. A blower device 130 is used to dry the sample after dye exhaustion.

Figure 1C:
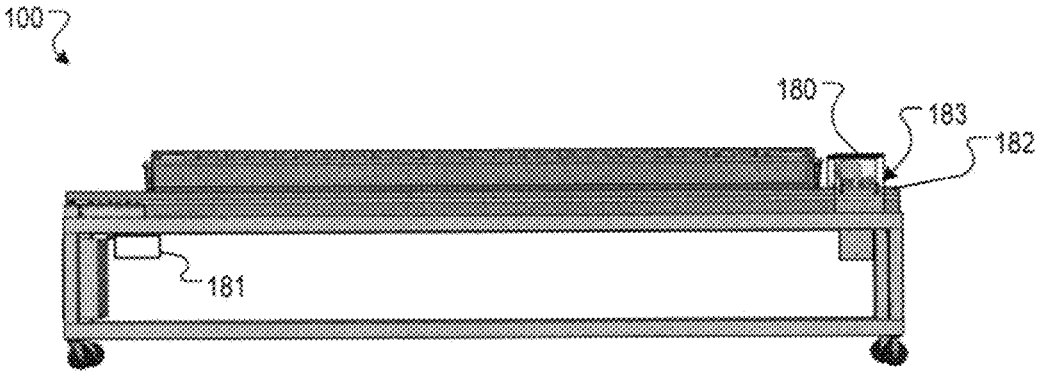
FIG. 1C is a front view of the dyeing and drying apparatus.

A frame 104 supports the platform 110 and a first housing 140. The first housing 140 is in movable disposition relative to the platform 110 such that the first housing 140, in a first position, defines a substantially enclosed cavity in which the flat top surface 106 of the platform 110 defines a bottom surface of the substantially enclosed cavity. FIGS. 1B and 1C show the first housing 140 in the first position, which is referred to as the closed position.

The first housing 140, in a second position, allows access to the top surface 106 of the platform 110 for placement and removal of the sample 102. The first housing in the second position, also referred to as the open position, is shown in FIG. 1A.

As shown in FIG. 1B, one or more microwave devices 160 are operatively positioned relative to the first housing 140, e.g., mounted in the top of the first housing, such that when the first housing 140 is in the closed position the magnetrons guide microwaves into the a substantially enclosed cavity in which the sample 102 is received. The microwave energy rapidly heats up the applied dye solution in the sample and exhausts the dye applied to the sample.

After the dye is exhausted, a control system 170 shuts off the microwave devices 160 and turns on the blower device 130. The blower device 130 is in fluid communication with the enclosed cavity by the supply plenum 122, and hot air is circulated through the cavity, and exits out of the return plenum 124, to dry the sample 102. After drying, the first housing 140 may be opened and the sample 102 removed for inspection.

The control system 170 may be used to manually turn on and turn off the microwave devices 160 and the blower system 130. Additionally, the control system 170 can be programmed to control the microwave devices 160 and the blower system 130 such that during a first time period, the microwave devices 160 are energized and the blower device 130 is not energized, and then during a second time period subsequent to the first time period, the microwave devices are de-energized and the blower device 130 is energized.

To apply dye to the sample 102, a dye applicator carriage 180 is movably disposed along a longitudinal axis 108 relative to the flat top surface 106 and is configured to deposit dye on sample 102 received on the top surface 106 as the dye applicator carriage 180 traverses the longitudinal axis 108. For example, the carriage 180 may include rollers 183 in engagement with a track 182, and may traverse the platform 110 by means of a driver 181, as shown in FIG. 1C. The driver 181 may be coupled to the carriage by means of a belt, or a screw drive, or any other appropriate driver mechanism.

As will be described in more detail below, the dye applicator carriage 180 includes a dye applicator 401 that deposits dye onto the sample 102, and an optional crush roller 184.

As shown in FIGS. 1A and 1B, first housing 140 is connected to one or more hinge devices 190 such that the movable disposition relative to the platform 110 is rotational. However, other mechanisms to move the first housing 140 into the proper position relative to the platform 110 for dye exhausting and drying can also be used. For example, the first housing 140 can be connected to a vertical elevator device (not shown) such that the movable disposition relative to the platform is elevational.

As shown in FIGS. 1B and 1C, the apparatus 100 is in the closed position, during which time an interior cavity is formed. The interior cavity is structured to dye exhaustion and drying. A variety of appropriate configurations may be use to facilitate such exhaustion and drying, two of which are described in more detail below.

Figure 2A:
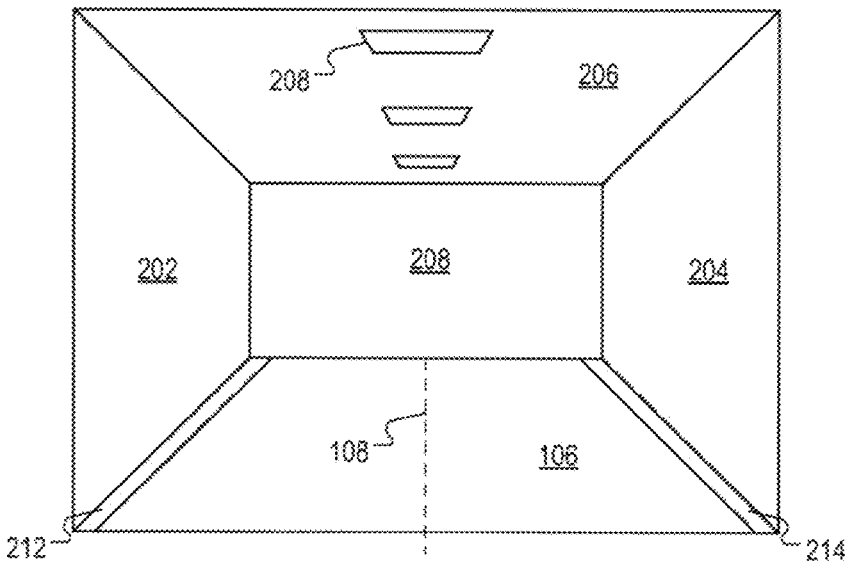
FIG. 2A is an illustration of a first implementation of the interior cavity of the apparatus.
Figure 2B:
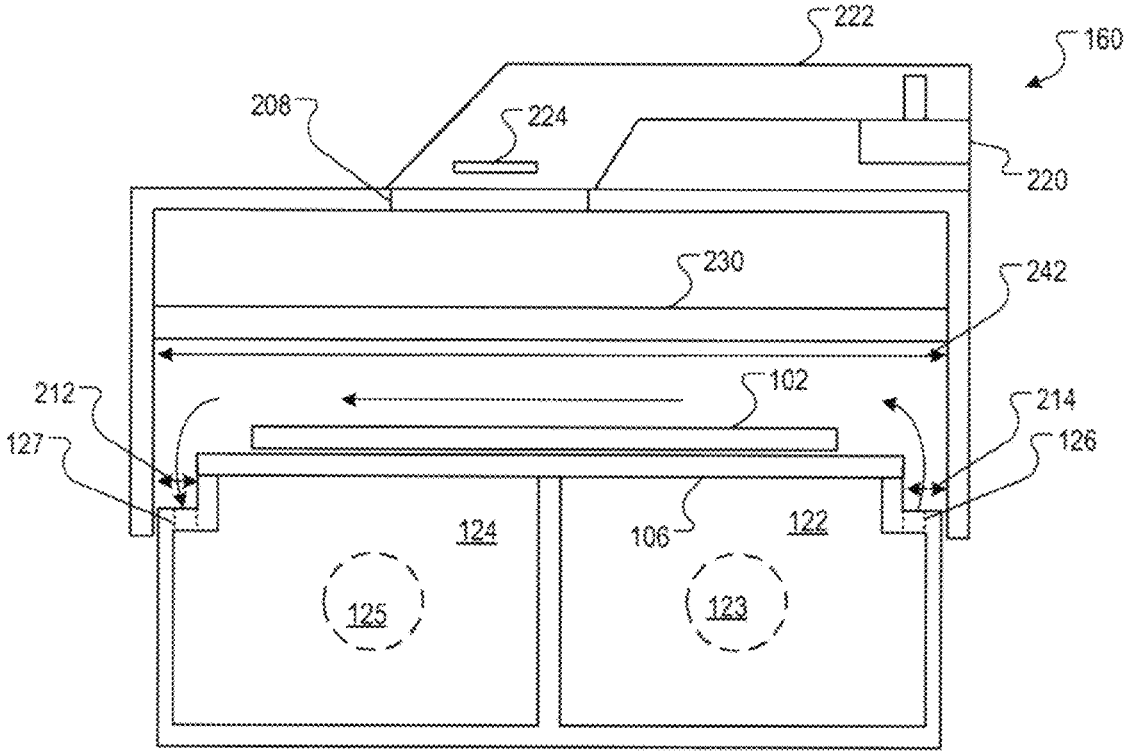
FIG. 2B is a cross-section illustration of the implementation of FIG. 2A.

FIGS. 2A and 2B are illustrations of a first implementation of the interior cavity of the apparatus 100. The cavity is defined by side walls 202 and 204, and ceiling 206, and a waveguide opening 208. Between the side walls 202 and 204 and the surface 206 are respective gaps. The supply plenum 122 includes a supply hole 123 that is connected to the blower system 130. The return plenum 124 includes an exit hole 125 though which air is exhausted after traversing from the supply plenum 122, though the cavity and into the return plenum 124, as indicated in FIG. 2B. That is, when the first housing 140 is in the first position, the plenums 122 and 124 are fluidly coupled to the substantially enclosed cavity, and the blower system 130 is fluidly coupled to the first plenum 122 so that air is communicated into the substantially enclosed cavity through the supply plenum 122 and communicated from the substantially enclosed cavity through the return plenum 124. The blower system 130 may optionally include heating elements so that the air blown into the supply plenum 122 is heated.

As shown in FIGS. 2A and 2B, the platform 140 defines a first side 202 and a second side 204 define a first width 242 such that the sides 202 and 204 close over the side walls of the platform 110. The substantially flat top surface 106 is of a second width that is less than the first width and positioned relative the longitudinal axis 108 such that a first gap 212 exists between the first side of the platform and a first side of the substantially flat top surface 106 and a second gap 214 exists between the second side of the platform and the second side of the substantially flat top surface. Within the gap 212 an egress 126 of the supply plenum 122 is located, and with the gap 214 an ingress 127 of the return plenum 124 is located. The ingress 126 and egress 127 may run substantially the length of the enclosed cavity so that air may flow evenly though the cavity during the drying process.

The microwave device 160 includes a magnetron 220 and a waveguide 222, and optionally a mode stirrer 224. When energized, the microwave device 160 imparts microwave energy into the cavity, which, in turn, heats the sample 102 and dye solution on the sample to exhaust the dye. However, even with a mode stirrer 224, there may appear standing wave patters such that the sample may not be heated evenly. Thus, in some implementations, a cavity barrier 230 is connected to the first housing 140 so that the cavity barrier 230 is in parallel planar disposition to the substantially flat top surface 160 when the first housing 140 is in the first position. The cavity barrier 230 substantially fluidly isolates the top portion of the substantially enclosed cavity from a bottom portion of the substantially enclosed cavity. The cavity barrier 230 comprises a microwave transparent material, such as tempered glass, for example. The height of the cavity barrier 230 from the substantially flat top surface 160 is selected so that resultant ambient heat of the air in the bottom portion of the substantially enclosed cavity overcomes non-uniform heating of sample caused by standing wave patterns, resulting in substantially uniform heating of the sample 102. In some implementations, the height may be on the order of 2-4 inches. Other heights may also be used.

Figure 3A:
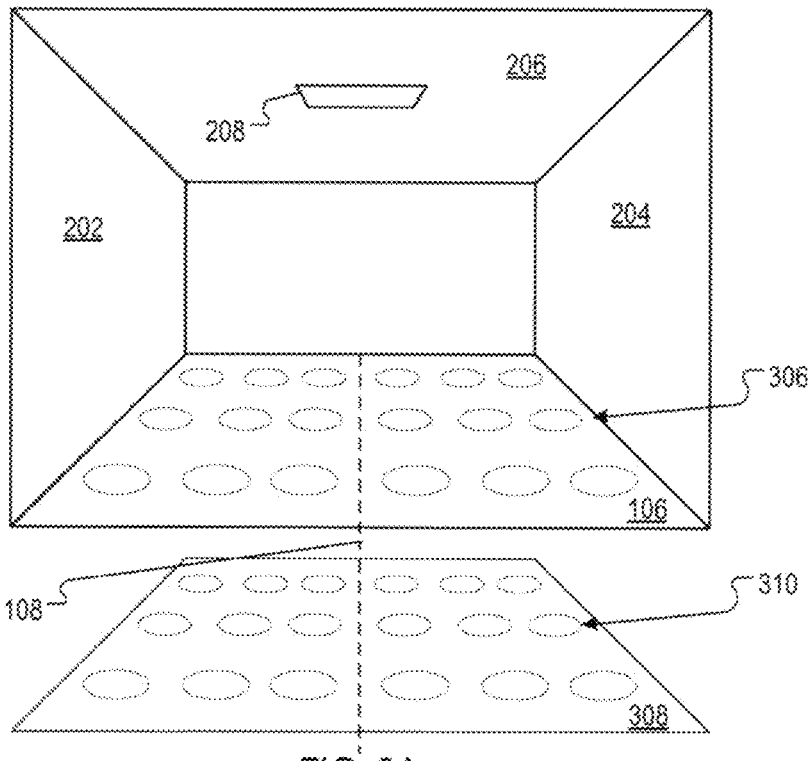
FIG. 3A is an illustration of a second implementation of the interior cavity of the apparatus.
Figure 3B:
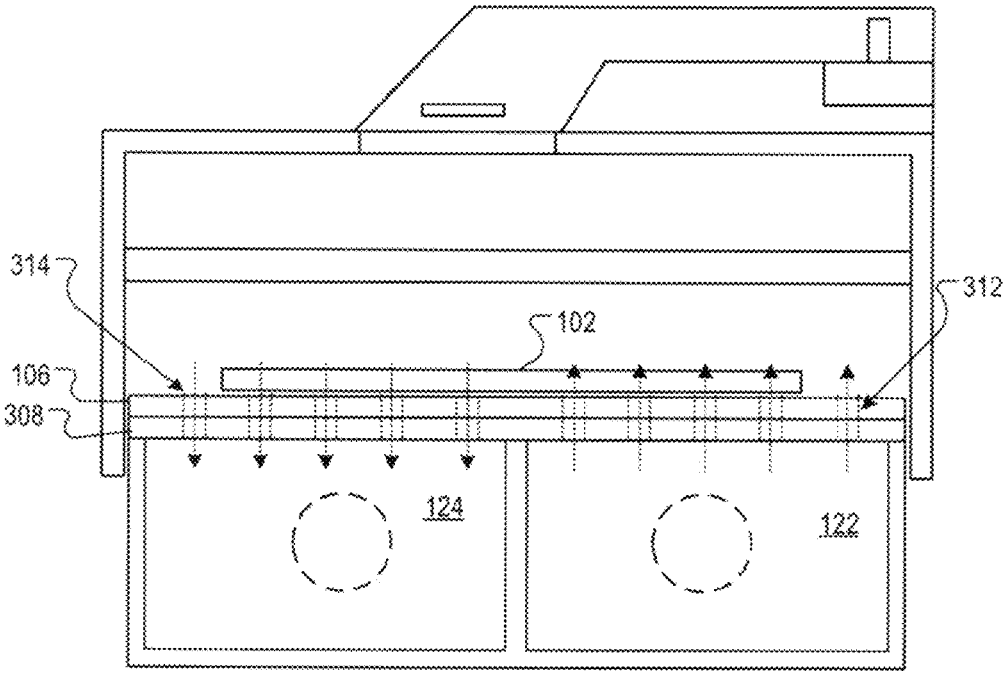
FIG. 3B is a cross-section illustration of the implementation of FIG. 3A.

Another appropriate configuration is shown in FIGS. 3A and 3B. In the implementation of FIGS. 3A and 3B, the substantially flat top surface includes a top surface sheet 106, having first perforations 306, and one or more second sheets 308 having second perforations 310. Each second sheet 308 is in slidable disposition relative to the first sheet 106. For example, the sheets may slide parallel to the longitudinal axis 108, or perpendicular to the axis 108. When each second sheet 308 is slidably disposed in a respective first position, the first and second perforations 306 and 310 are aligned to form a respective egresses 312 for a respective portion of the supply plenum 122 and a respective ingresses 314 for a respective portion of the return plenum 124. Conversely, when each second sheet 308 is slidably disposed in a respective second position, the first and second perforations 306 and 310 are not aligned such that the respective portion of the supply plenum 122 does not have an egress for the second sheet 308 and the respective portion of the return plenum 124 does not have an ingress for the second sheet 308.

Such a latter configuration is useful when processing samples 102 that are less than the entire length of the surface 106, e.g., a four foot sample 102 when using an apparatus with a 14 foot long top surface 106. In such a scenario 10 feet of the plenums 122 and 124 are configured to not have either an ingress or egress.

In some implementations, the apparatus 100 includes a dye applicator carriage 180 that includes a dye applicator. The dye application carriage traverses the longitudinal axis 108 of the apparatus 100 to apply dye to a sample 102. As will be described below, the application of the dye is regulated such that the dye flow is substantially even during the entire traversal of the apparatus 100. This is accomplished by a passive head regulator 410.

Furthermore, application of the dye is also consistent across the width of the sample 102 due to an applicator valve 450 that includes rotationally aligned slots to control the flow of the dye and which dispenses the dye is an uninterrupted and uniform cascade of dye solution for the length of the slot. Accordingly, the dye applicator maintains a regulated back pressure across the entire sample, and while traversing the sample 102, evenly distributes dye across the width of the sample.

Figure 4A:
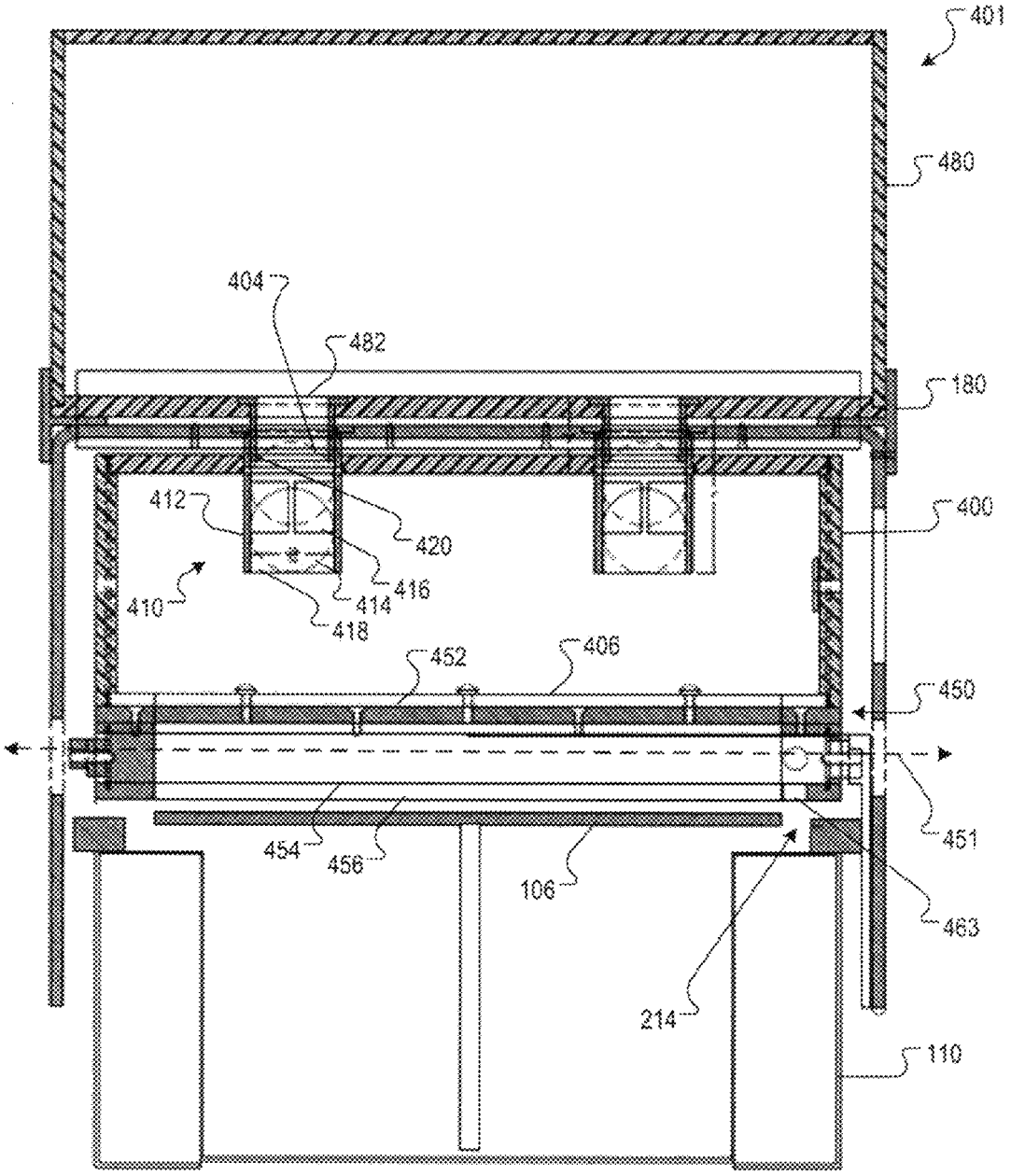
FIGS. 4A and 4B are front and side views of the dye applicator.
Figure 4B:
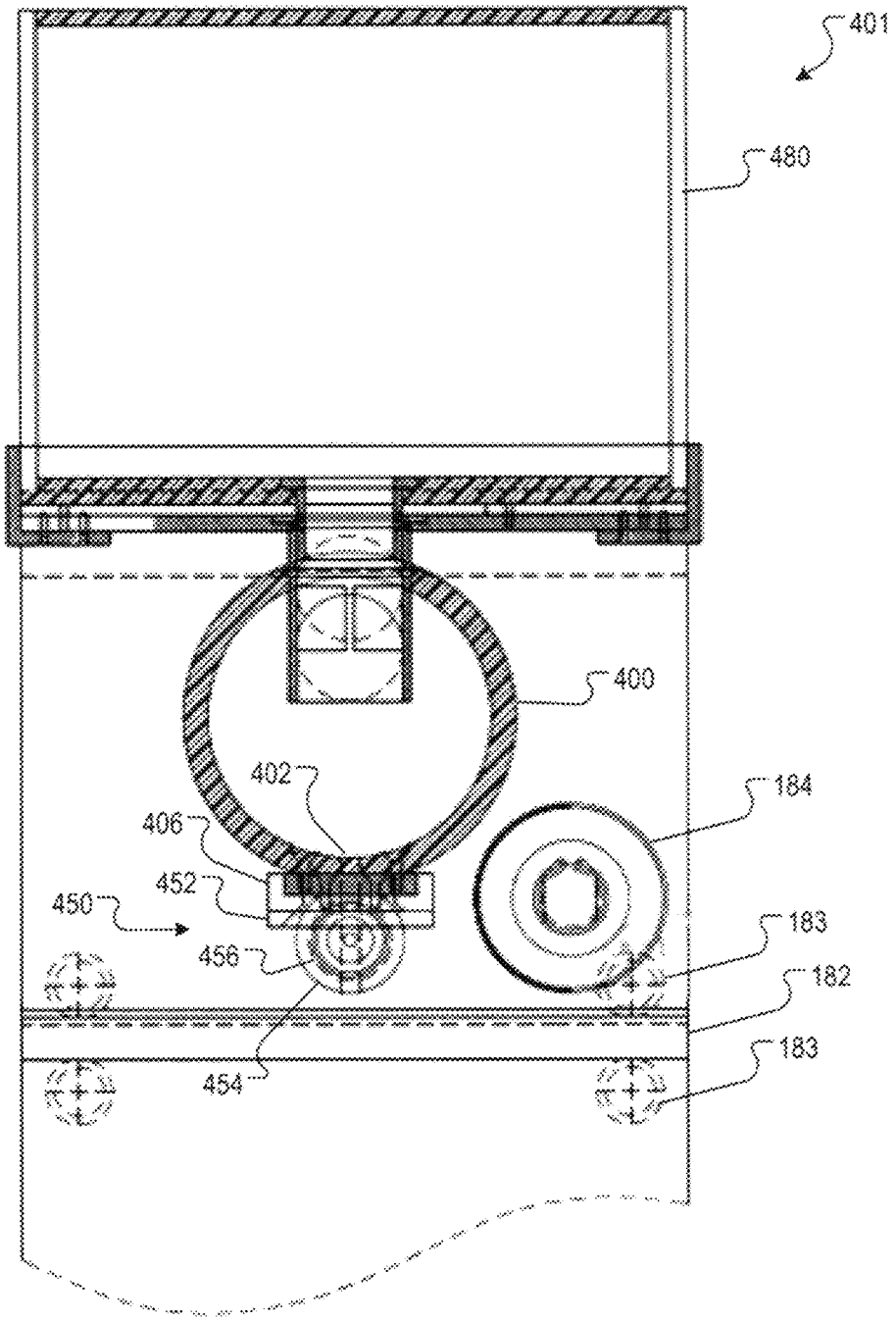

The dye applicator 401 is described with reference to FIGS. 4A-6C below. FIGS. 4A and 4B are front and side views of a dye applicator 401. The carriage 180 holds a first reservoir 400, a second reservoir 480, the applicator valve 452, and a crush roller 184. In operation, the applicator 401 deposits dye on the sample 102, and the optional crush roller then rolls over the sample 102 after the dye has been applied. The applicator 401 traverses by means an applicator carriage driving of rollers 183 engaged on a track 182 on the sides of the platform 110. The driver 181 of FIG. 1C controls movement of the applicator 401.

The first fluid reservoir 400 defines a first volume for holding a first volume of fluid and also defines a first port 402 through which fluid may escape. The applicator valve 450 defines a longitudinal axis 451 that is substantially perpendicular to the longitudinal axis 108 of the apparatus 100. The applicator value 450 is connected to the first fluid reservoir by means of the first port 402, as will be described in more detail below.

Also as depicted in FIGS. 5A-6C, the applicator valve 450 connects to the first fluid reservoir 400 by means of a mounting plate 452. The applicator valve 450 has a casing 454 defining an inner cavity defined by a casing wall and in which a rotor 456 is inserted. The casing 454 has first and second ends, and further defines a first longitudinal slot 458 through the casing wall and a second longitudinal slot 459 through the casing wall. The first and second longitudinal slots are substantially parallel to the longitudinal axis 451. The first longitudinal slot 451 is fluidly connected to the first port 402 of the first reservoir 400. In some implementations, the first port 402 is also a longitudinal slot, and the mounting plate 452 also has a longitudinal slot 452. The slots 402 and 458 are aligned to form a continuous vertical slot through which fluid from the first reservoir 400 may flow.

Figure 6A:
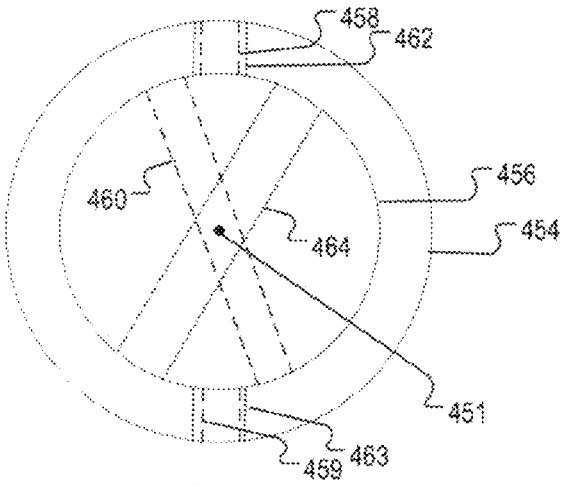
FIGS. 6A, 6B and 6C are cross-section views of the rotor in respective first, second and third positions within a casing of the applicator valve.
Figure 6B:
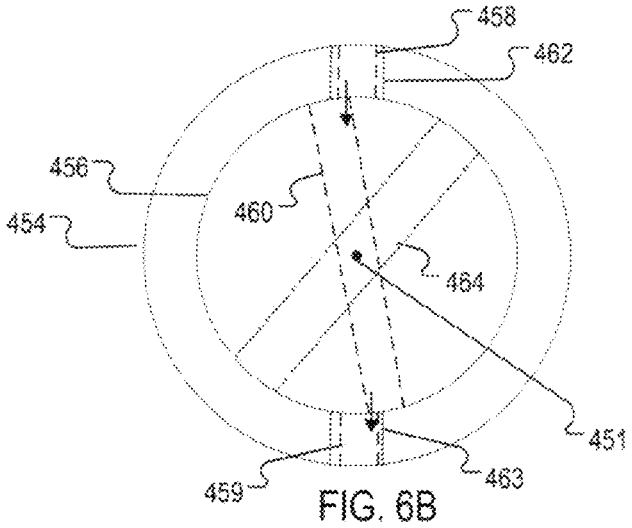

Within the casing 454 inner cavity is the rotor 456. The rotor 456 defines an outer surface and a third longitudinal slot 460 cut through the rotor 456. The third longitudinal slot 460 is also substantially parallel to the longitudinal axis 451. The rotor 456 is operable to rotate about a rotational axis that is substantially parallel to the longitudinal axis 451 such that the outer surface of the rotor 456 seals the first longitudinal slot 458 from the second longitudinal slot 459 when the slots 458 and 459 are not aligned with the slot 460, as shown in FIG. 6A. In this position, fluid will not flow from the first reservoir 400.

However, when the rotor 456 is rotated so that the third slot 460 is at least partially aligned with the slots 458 and 459, the longitudinal slot 460 forms a fluid path from the first longitudinal slot 458 to the second longitudinal slot 459. This alignment allows the flow of fluid from the reservoir 400 and out of the bottom slot 459. The angel of alignment may be used to control the flow rate of the fluid. Furthermore, due to the slot alignments, the resulting flow of fluid from the bottom slot 459 appears as uninterrupted cascading sheet of fluid, which results in a consistent application of dye across the width of the sample 102. Note that the width of the sample is selected to be less than or equal to the width of the slot 459.

In some implementations, the casing 454 includes at least respective pair of a first drain hole 462 and a second drain hole 463. The first drain hole 460 also aligns with a drain hole 460 in the mounting plate 452, and the drain hole 460 is fluidly coupled to the reservoir 400. The drain holes 462 and 463 are respectively interposed between respective ends for the first and second longitudinal slots 458 and 459 of the casing 454. As shown in FIG. 4A, the drain hole 463 in the casing 454 aligns with a gap, e.g., gap 214, to allow fluid to be drained after application to the sample 102.

Figure 5A:
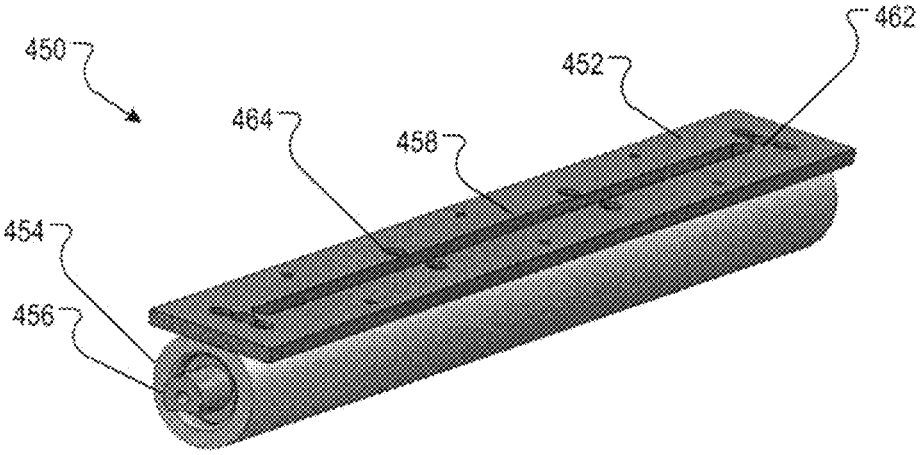
FIGS. 5A and 5B are perspective views of the applicator valve.
Figure 5B:
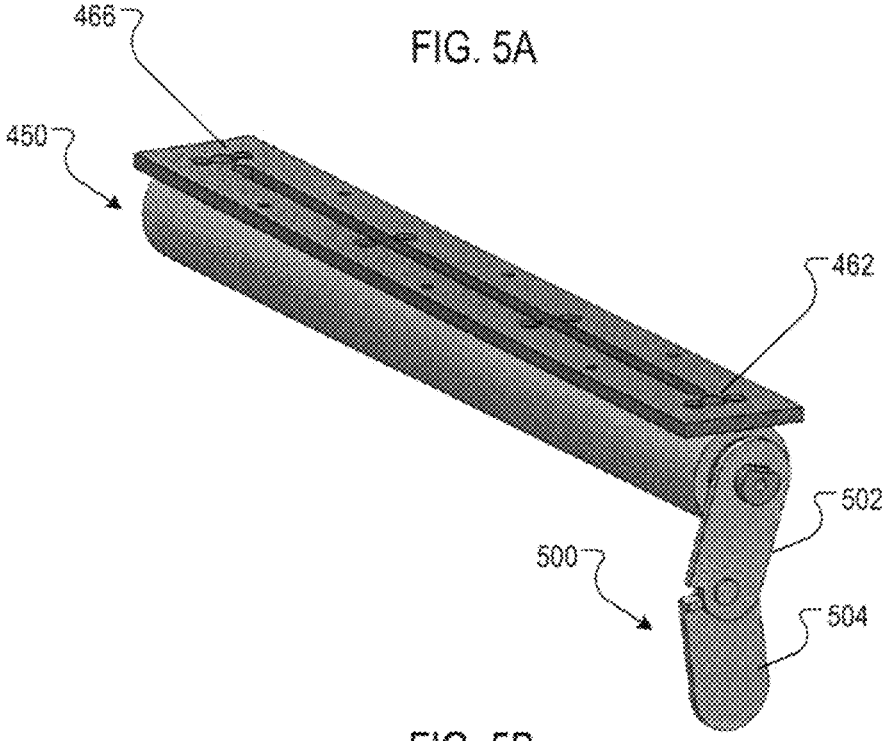
Figure 5C:
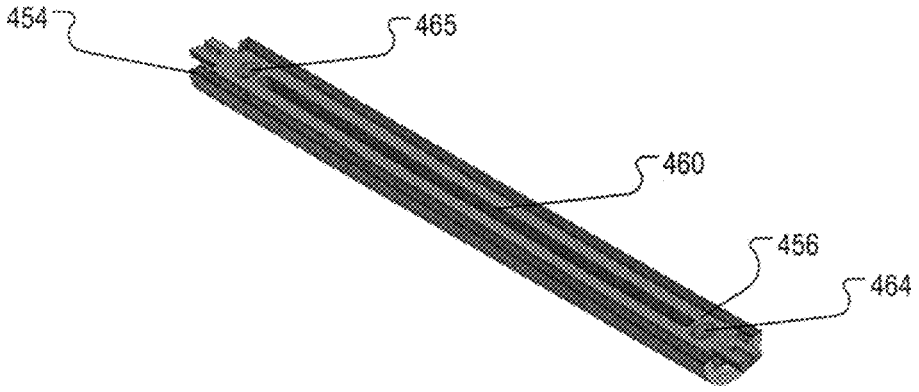
FIGS. 5C and 5D are perspective cut views of the applicator valve.
Figure 5D:
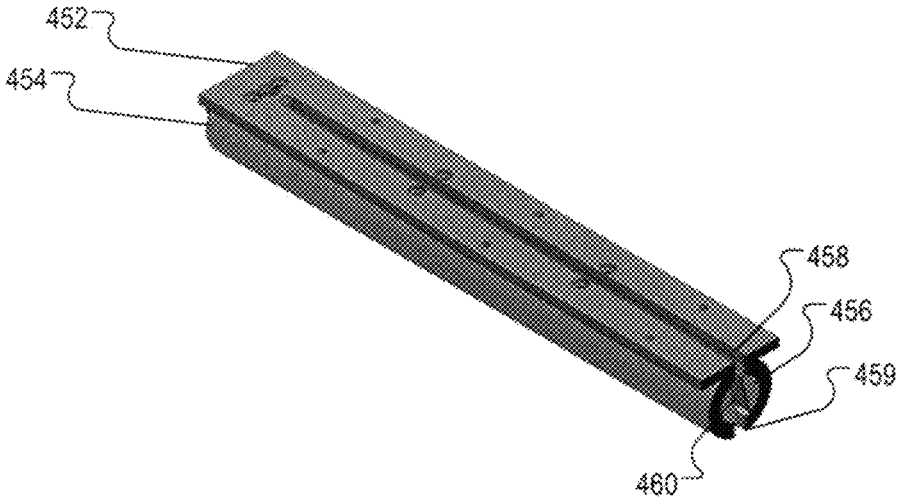
Figure 6C:
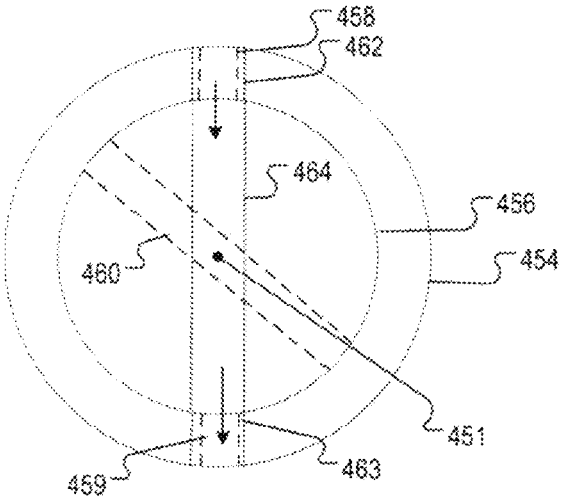

As shown in FIG. 5C, the rotor 456 defines at least one through hole 464 interposed between the third longitudinal slot 460 and the first end of the rotor. As shown in FIGS. 5C and 6C, a bore axis of the through hole 464 is angularly offset from a bore axis of the longitudinal slot 460 such that when the through hole 464 is aligned with the first and second drain holes 462 and 463 to form a fluid path from the first drain hole 462 to the second drain hole 463, the outer surface of the rotor 456 seals the first longitudinal slot 458 from the second longitudinal slot 459. Thus, fluid may drain from the reservoir 400 through the drain hole 463, but fluid will not drain though the bottom slot 463. As shown in FIGS. 5B and 5C, another through hole 465 may be similarly disposed on an opposite side of the rotor, and another pair of drain holes (of which only 466 is shown in FIG. 5B) may be similarly disposed in the opposite side of the casing 454.

Rotation of the rotor 456 may be done either mechanically or electromechanically. In the case of the latter, actuators, such as solenoids, may be used to move the rotor to various positions during movement and parking of the applicator 401. In the case of the form, a split lever 500, such as illustrated in FIG. 5B, may be used to move the rotor 456 to a first angle when traversing in a first direction, and to a second angle when traversing in a second, opposite direction, where one of the positions deposits dye though the bottom slot 459, and the other position precludes dye from escaping from either the bottom slot 459 or the drain hole 463.

The lever 500 includes a first arm 502 and a second arm 504, and traverses a cam surface (not shown). When traversing in the first direction, the second arm 504 may not flex and the first position is obtained. However, when traversing in the second, opposite direction, the second arm 504 may flex and the second position is obtained.

To drain the applicator 481, the lever 500 may be, for example, manually actuated, or may ride up a cam surface (not shown) to rotate the rotor 456 into the position shown in FIG. 6C.

In some implementations, the applicator 481 includes a head regulator 410 to passively regulate fluid pressure as fluid is drained. This allows for an even flow rate of fluid as the applicator 481 traverses the longitudinal axis 108 of the apparatus 100. The head regulator 410 is used in conjunction with a second reservoir 400. Although two head regulators 410 are shown in FIG. 4A, more or fewer head regulators may be used. For brevity, only one of the head regulators is described.

As shown in FIGS. 4A and 4B, the first fluid reservoir 400 further defines a second port 404 through which fluid may enter the first fluid reservoir 400. The second fluid reservoir 480 defines a second volume for holding a second volume of fluid and defines a third port 482 fluidly coupled to the second port 404 and through which fluid may escape the second fluid reservoir. The head regulator 410 governs fluid flow from the third port 483 to the second port 404 to regulate head caused by the fluid in the second reservoir 480.

The head regular 410 includes a float 414 that is positively buoyant relative to a fluid to be stored in the first and second fluid reservoirs 440 and 480. A conduit 412 fluidly couples the third port 482 of the second reservoir 480 to the second port 404 of the first fluid reservoir 440, and further extends into the first volume of the first fluid reservoir 440. The conduit 412 includes a bottom stop 418 that prevents the float 414 from dropping out of the conduit.

Within the conduit 412 are cut one or more openings 416 through which fluid may flow. The openings 416, in some implementations, are cut into the sides of the conduit 412 so as to direct fluid flow into the first reservoir in a direction away from the first port 402 at the bottom of the reservoir. This helps reduce turbulence at the bottom of the first reservoir, which, in turn, reduces disturbances in the dye waterfall that flows from the bottom slot 459.

The float 414 is received within the conduit 412 and rests against the bottom stop 418 when a fluid level in the first fluid reservoir 400 is below the bottom stop 418, and rises to a maximum level as the fluid level in the first fluid reservoir 400 rises above the bottom stop 418. At the maximum level the float 414 substantially seals the conduit 412 by forming a seal 420 such that fluid flow into the third port is inhibited. For example, if the float 414 is spherical in shape, the conduit 412 (or the edge of the third port 482) my include a circular opening having edges that match a radius of curvature of the float 414 such that the upward pressure of the float 414 forms a seal and inhibits flow. Thereafter, as flow flows from the reservoir 400, the float will sink 414 and more fluid will flow in from the first reservoir 480, which, in turn, causes the float 414 to rise and again seal the conduit 412. The opening and closing caused by the float 414 regulates the head caused by the fluid in the second reservoir such that the flow rate of fluid flowing out of the slot 459 is substantially stead. For example, despite that the first reservoir may be substantially depleted during the entire traversal of the apparatus 100 at a particular speed, the flow rate out of the slot 459 may deviate by less than 5% during the entire traversal of the apparatus 100 at the particular speed.

Together, the slot configured valve 452 and the head regulator 410 allow for the steady and consistent application of day across a sample 102.

Control features of subject matter and the operations described in this specification can be implemented in digital electronic circuitry, or in computer software, firmware, or hardware, including the structures disclosed in this specification and their structural equivalents, or in combinations of one or more of them.

The operations described in this specification can be implemented as operations performed by a data processing apparatus on data stored on one or more computer-readable storage devices or received from other sources. The term "data processing apparatus" encompasses all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application-specific integrated circuit).

While this specification contains many specific implementation details, these should not be construed as limitations on the scope of any features or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims.

What is claimed is:

1. An apparatus, comprising:

a first fluid reservoir defining a first volume for holding a first volume of fluid and defining a first port through which fluid may escape the first fluid reservoir, and further defining a second port through which fluid may enter the first fluid reservoir;

a second fluid reservoir defining a second volume for holding a second volume of fluid and defining a third port through which fluid may escape the second fluid reservoir, wherein the third port of the second fluid reservoir is in fluid communication with the second port of the first fluid reservoir; and an applicator valve defining a longitudinal axis and connected to the first fluid reservoir, comprising:

a casing having an inner cavity defined by a casing wall and having a first end and a second end, and further defining a first longitudinal slot through the casing wall and a second longitudinal slot through the casing wall, wherein the first and second longitudinal slots are substantially parallel to the longitudinal axis, and the first longitudinal slot is fluidly connected to the first port of the reservoir; and a rotor within the inner cavity of the casing and having a first end and a second end, and defining an outer surface and a third longitudinal slot cut through the rotor, the third longitudinal slot substantially parallel to the longitudinal axis, and wherein the rotor is operable to rotate about a rotational axis that is substantially parallel to the longitudinal axis such that the outer surface of the rotor seals the first longitudinal slot from the second longitudinal slot, and the third longitudinal slot forms a fluid path from the first longitudinal slot to the second longitudinal slot when the third longitudinal slot is at least partially aligned with the first and second longitudinal slots; and a head regulator comprising:

a float that is positively buoyant relative to the fluid to be stored in the first and second fluid reservoirs; and a conduit fluidly coupling the third port of the second reservoir to the second port of the first fluid reservoir, and further extending into the first volume of the first fluid reservoir, the conduit including a bottom stop, wherein the float is received within the conduit and rests against the bottom stop when a fluid level in the first fluid reservoir is below the bottom stop, and rises to a maximum level as the fluid level in the first fluid reservoir rises above the bottom stop, wherein at the maximum level the float substantially seals the conduit such that fluid flow into the third port is inhibited;

wherein the head regulator governs fluid flow from the third port to the second port to regulate head caused by the fluid in the second reservoir while the rotor is positioned so the third longitudinal slot forms the fluid path from the first longitudinal slot to the second longitudinal slot thereby causing fluid to drain from the first fluid reservoir, the head being regulated such that a rate of fluid flow through the fluid path is substantially constant as the head caused by the fluid in the second reservoir decreases.

2. The apparatus of claim 1, wherein:

the first port is defined by a fourth longitudinal slot substantially parallel to the first longitudinal slot in the casing and aligned with the first longitudinal slot in the casing; and the second longitudinal slot in the casing is of second length and the third longitudinal slot is of a third length that is substantially equal to the second length.

3. The apparatus of claim 1, further comprising:

a crush roller that rolls over a surface upon which fluid is deposited from the second longitudinal slot.

4. An apparatus, comprising:

a first fluid reservoir defining a first volume for holding a first volume of fluid and defining a first port through which fluid may escape the first fluid reservoir;

an applicator valve defining a longitudinal axis and connected to the first fluid reservoir, comprising:

a casing having an inner cavity defined by a casing wall and having a first end and a second end, and further defining a first longitudinal slot through the casing wall and a second longitudinal slot through the casing wall, wherein the first and second longitudinal slots are substantially parallel to the longitudinal axis, and the first longitudinal slot is fluidly connected to the first port of the reservoir; and a rotor within the inner cavity of the casing and having a first end and a second end, and defining an outer surface and a third longitudinal slot cut through the rotor, the third longitudinal slot substantially parallel to the longitudinal axis, and wherein the rotor is operable to rotate about a rotational axis that is substantially parallel to the longitudinal axis such that the outer surface of the rotor seals the first longitudinal slot from the second longitudinal slot, and the third longitudinal slot forms a fluid path from the first longitudinal slot to the second longitudinal slot when the third longitudinal slot is at least partially aligned with the first and second longitudinal slots;

wherein:

the casing further defines a first drain hole and a second drain hole, the first and second drain holes respectively interposed between respective ends of the first and second longitudinal slots and the first end of the casing; and the rotor defines a through hole though the rotor and interposed between the third longitudinal slot and the first end of the rotor and wherein a bore axis of the through hole is offset from a bore axis of the third longitudinal slot such that when the through hole is aligned with the first and second drain holes to form a fluid path from the first drain hole to the second drain hole, the outer surface of the rotor seals the first longitudinal slot from the second longitudinal slot.

* * * * *